US010446125B2

(12) United States Patent
Juravich

(10) Patent No.: US 10,446,125 B2
(45) Date of Patent: Oct. 15, 2019

(54) CYMBAL SPINNER

(71) Applicant: Neue Gestalt LLC, Philadelphia, PA (US)

(72) Inventor: Guy Juravich, Philadelphia, PA (US)

(73) Assignee: Neue Gestalt LLC, Pottstown, PA (US)

( * ) Notice: Subject to any disclaimer, the term of this patent is extended or adjusted under 35 U.S.C. 154(b) by 0 days.

(21) Appl. No.: 15/912,799

(22) Filed: Mar. 6, 2018

(65) Prior Publication Data

US 2018/0254029 A1 Sep. 6, 2018

Related U.S. Application Data

(60) Provisional application No. 62/467,435, filed on Mar. 6, 2017.

(51) Int. Cl.
*G10G 5/00* (2006.01)
*G10D 13/06* (2006.01)

(52) U.S. Cl.
CPC ..... *G10G 5/005* (2013.01); *G10D 13/06* (2013.01)

(58) Field of Classification Search
CPC ..... G10G 5/005; G10D 13/06
USPC ..... 84/422.1
See application file for complete search history.

(56) References Cited

U.S. PATENT DOCUMENTS 1,607,769 A * 11/1926 Meyer ..... G10D 13/06 248/298.1
2,854,880 A * 10/1958 Waters ..... G10G 5/005 84/421
3,336,827 A * 8/1967 Gaylor ..... G10D 13/06 84/422.3
3,513,918 A * 5/1970 Coffman ..... B25D 11/102 173/203
3,592,097 A * 7/1971 Friede ..... G10D 13/003 84/402
3,710,669 A * 1/1973 Jones ..... G10D 13/06 84/402
3,730,047 A * 5/1973 Casavant ..... G10D 13/06 84/402
3,742,810 A * 7/1973 Crigger ..... G10D 13/065 84/422.3
4,200,024 A * 4/1980 Watson ..... G10D 13/06 84/421
4,346,637 A * 8/1982 Janszen ..... G10D 13/06 84/418
4,381,690 A * 5/1983 Kimble ..... G10D 13/065 248/171
4,510,838 A * 4/1985 Alexis, Jr. ..... G10G 5/00 84/422.3

(Continued)

OTHER PUBLICATIONS

Pearl Drums Spare Parts Catalog—2012, pp. (26-34), www.pearldrums.com.

*Primary Examiner* — David S Warren
*Assistant Examiner* — Christina M Schreiber
(74) *Attorney, Agent, or Firm* — Panitch Schwarze Belisario & Nadel LLP

(57) ABSTRACT

A cymbal spinner, preferably a stand-mountable cymbal spinner, includes a housing having a base and an extension generally perpendicular to the base and a roller ball bearing mounted in the housing base, the roller bearing being mountable on a cymbal stand, and the cymbal spinner housing being capable of supporting a cymbal such that the cymbal is adapted to spin.

8 Claims, 3 Drawing Sheets

(56) References Cited

U.S. PATENT DOCUMENTS

| | | | | | |
|---|---|---|---|---|---|
| 4,526,083 | A * | 7/1985 | LeMert | G10D 13/06 | 403/220 |
| 4,960,028 | A * | 10/1990 | Ramirez | G10D 13/06 | 84/421 |
| 4,987,817 | A * | 1/1991 | Diaz | G10D 13/06 | 84/421 |
| 5,052,262 | A * | 10/1991 | Havens | G10D 13/065 | 84/421 |
| 7,078,606 | B2 * | 7/2006 | Tanaka | G10D 13/065 | 84/422.1 |
| 7,663,040 | B1 * | 2/2010 | Hsieh | G10D 13/06 | 248/187.1 |
| 9,842,574 | B2 * | 12/2017 | McFadden | G10D 13/026 | |
| 2006/0027072 | A1 * | 2/2006 | Morelli | G10D 13/06 | 84/422.3 |
| 2006/0156910 | A1 * | 7/2006 | Yoshino | G10H 1/34 | 84/723 |
| 2011/0072953 | A1 * | 3/2011 | Crelin | F16B 9/026 | 84/421 |
| 2013/0174711 | A1 * | 7/2013 | Lin | G10D 13/06 | 84/422.3 |
| 2018/0254029 | A1 * | 9/2018 | Juravich | G10G 5/005 | |

* cited by examiner

CYMBAL SPINNER

CROSS-REFERENCE TO RELATED APPLICATIONS

The present application claims priority to U.S. Patent Application No. 62/467,435, filed Mar. 6, 2017 and entitled "Cymbal Spinner."

BACKGROUND OF THE INVENTION

One or more cymbals mounted on one or more cymbal stands are important musical instruments for a percussionist, whether the percussionist is performing in an orchestra with a single cymbal mounted on a single stand, a dance band, a rock band or any other type of band, with multiple cymbals supported on multiple stands. Typically, stand-mounted cymbals are mounted on top of a felt washer on a mounting rod that can or need not be threaded and located at the upper end of a cymbal stand, which often may be located in the vicinity of other drum or percussion instruments in a drum set. Stand-mounted cymbals are not adapted to and do not rotate, as they are most often held in place on the threaded mounting rod by a nut that may have a felt washer between the nut and the top of the cymbal.

The present invention, a cymbal spinner, and preferably a stand-mountable cymbal spinner, contrary to the usual situation, not only allows the cymbal mounted on a stand to spin, but also enables the cymbal mounted on the stand using the cymbal spinner of the present invention to spin, encouraging spinning of the cymbal for a long period of time, and providing for a desirable vibrato effect when the spinning cymbal is struck with a drumstick, mallet, brush or the like (hereinafter, generically "drumstick"), similar to the sound from a vibraphone or rotary speaker.

Before this invention, there was no need or desire to spin a cymbal during performances. Using the invention, now known by the applicant's trademark as a "Spinbal™" cymbal spinner, is easy: a drummer need only apply the cymbal spinner to his or her cymbal stand and simply spin the cymbal as one would a lazy susan, with the flick of the wrist. There is no existing cymbal holder designed to spin. Before the present invention, the effect had not been used or observed. The present invention allows an entirely new approach to playing cymbals that includes kinetic sound properties, unique performance methods and endless possibilities in variety of tones.

BRIEF SUMMARY OF THE INVENTION

The present invention relates to a cymbal spinner, preferably a stand-mountable cymbal spinner, comprising a housing having a base and an extension generally perpendicular to the base and a roller ball bearing mounted in the housing base, the roller bearing being mountable on a cymbal stand, and the cymbal spinner housing being capable of supporting a cymbal such that the cymbal is adapted to spin.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
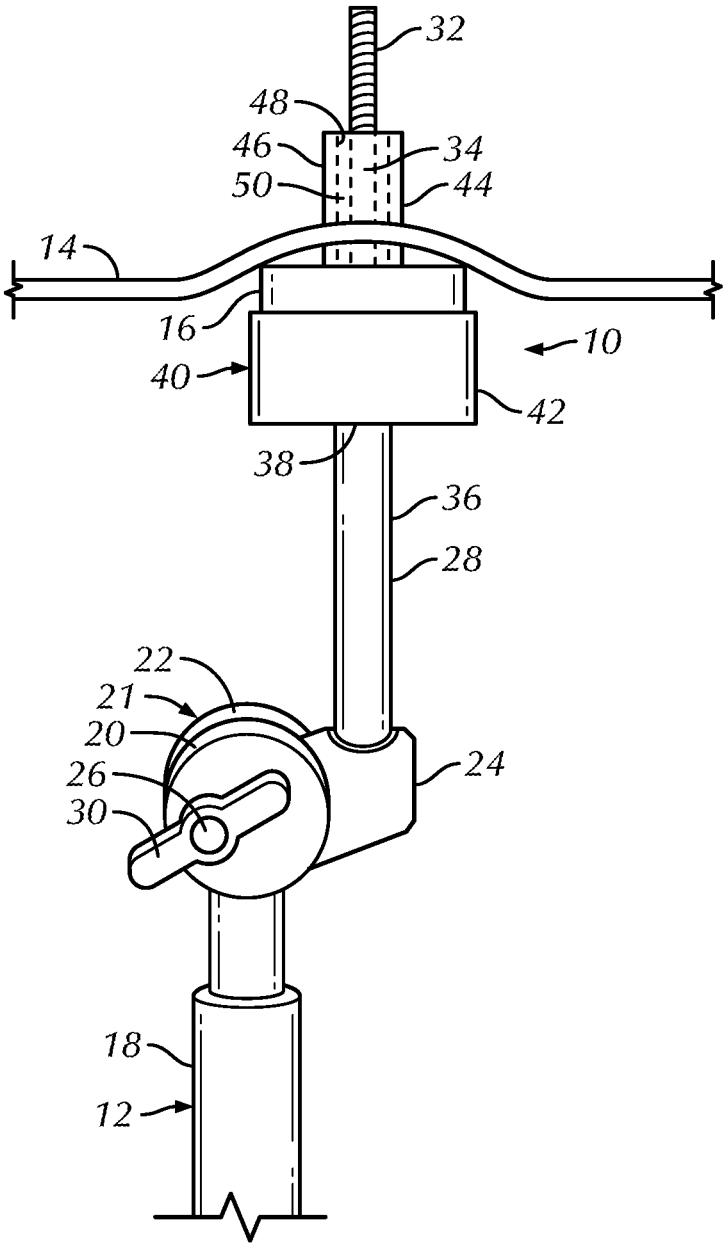
FIG. 1 is a side elevation view of the cymbal spinner of the present invention mounted on a cymbal stand with a cymbal mounted on the cymbal spinner on top of a felt washer.
Figure 2:
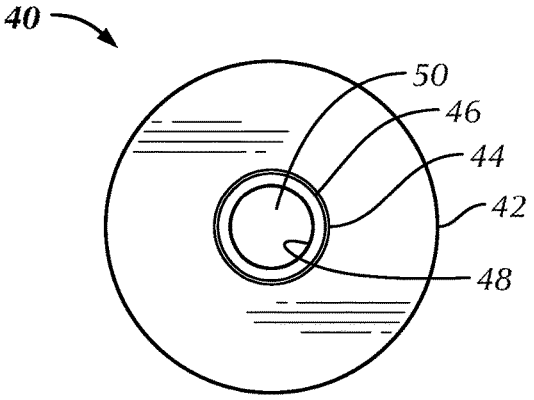
FIG. 2 is a top plan view of the cymbal spinner housing.
Figure 3:
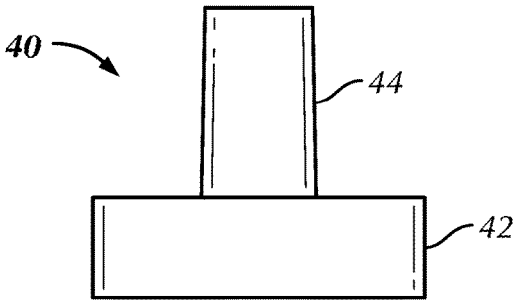
FIG. 3 is a side view of the cymbal spinner housing.
Figure 4:
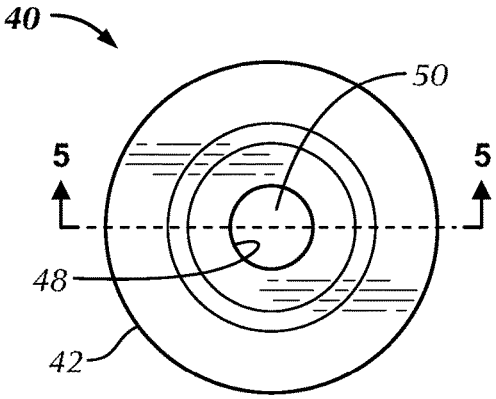
FIG. 4 is a bottom plan view of the cymbal spinner housing.
Figure 5:
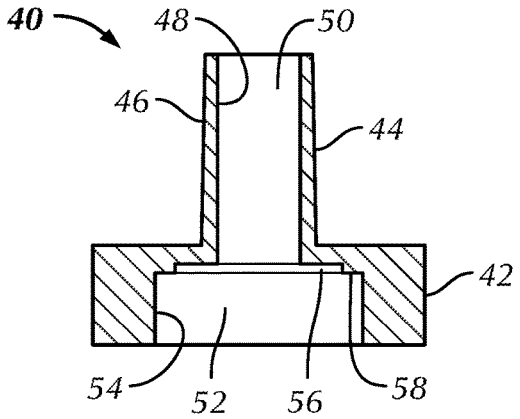
FIG. 5 is a vertical cross-sectional view of the cymbal spinner housing taken along lines 5-5 of FIG. 4.

Referring to the drawings, where like numerals identify like elements throughout the several views, FIG. 1 shows a side elevation view of the cymbal spinner 10 of the present invention in the environment in which it is intended to be used. The cymbal spinner 10 is mounted on a cymbal stand 12 with a cymbal 14 (partially shown with the radial sides terminated for purposes of illustration) mounted on the cymbal spinner 10 on top of a felt washer 16. More particularly, atop portion of the cymbal stand, which may be any type of a stand for mounting a cymbal, is shown schematically as having an adjustable height support members 18, such as telescoping tubes, ending at is upper end in one half 20 of a rotatably adjustable member 21. The other half 22 of the rotatably adjustable member 21 includes a cymbal mount rod support portion 24 and a threaded bolt 26. The two halves 20 and 22 of the rotatably adjustable member 21 rotate with respect to each other and are held in a desired position so that the supported cymbal 14 is held at a desired angle on the cymbal spinner 10, in turn supported on a cymbal mount rod 28. The halves of the rotatably adjustable member are retained in a desired position by a wing nut 30 that tightens on the threaded bolt 26.

The cymbal mount rod 28 has at its upper end an optional upper threaded rod portion 32 that can support an optional nut with mating threads. The threaded rod portion 32 can but need not have a smooth, unthreaded portion 34 below the upper threaded rod portion 32. For purposes of clarification, the upper rod portions of the cymbal mount rod 28 shown as the upper threaded rod portion 32 and the smooth unthreaded portion 34 are merely exemplary, since the upper portions can be entirely threaded or entirely smooth. The upper threaded rod portion 32 and the smooth portion 34 have smaller diameters than a lower portion 36 of the cymbal mount rod 28, so that there is a seat 38 formed between the greater diameter lower portion 36 of the cymbal mount rod 28 and the smaller diameter smooth portion 34 of the cymbal mount rod 28.

With reference to FIGS. 1 through 5, the cymbal spinner 10 includes a housing 40 with a housing base 42 and a housing extension 44 that is generally perpendicular to the base 42, more particularly, generally perpendicular to the bottom of the base 42. The top surface of the housing base is generally parallel to the bottom of the housing base, but the top surface and bottom being generally parallel to each other is not essential. As used herein, the term "generally" or derivatives thereof with respect to any element or parameter means that the element or parameter has the basic shape, or the element or parameter has the same basic direction, orientation or the like to the extent that the function of the element or parameter would not be materially adversely affected by somewhat of a change in the element or parameter. By way of example and not limitation, the housing extension 44 being "generally perpendicular" to the housing base 42 means that the extension can be oriented a few degrees more or less than exactly 90° with respect to absolutely perpendicular, where such variations do not materially adversely affect the function of the cymbal spinner 10 because of the orientation of the housing extension 44 in relation to the housing base 42. Since the housing is preferably molded, the walls of the housing have a slight release angle to remove the housing readily from the mold.

While the exterior of the cymbal spinner may have any suitable shape to be functional, it is presently preferred that both the housing base 42 and the housing extension 44 are generally cylindrical, with the housing base 42 having a larger diameter than the housing extension 44. The housing base and housing extension are preferably integral with each other and more preferably are molded in a unitary manner from any suitable material, preferably a durable synthetic polymer, such as nylon or other engineering plastic. Nylon 6 is the presently preferred material for the housing 40 of the cymbal spinner 10.

As shown best in FIGS. 1, 2, 4 and 5, the housing extension 44 has an outer wall 46 and an inner wall 48. The inner wall defines a bore 50 extending longitudinally through the housing extension. The bore 50 should have a diameter slightly greater than the diameter (or cross-sectional dimension, if not cylindrical) of the upper portions 32 and 34 of the cymbal mount rod 28. This is to enhance the spinning of the cymbal spinner 10 and any cymbal mounted on it, such that there is no or at least minimal friction between the inner wall 48 of the housing extension 44 and the upper portions 32 or 34 of the cymbal mount rod 28.

The housing base 42 also has a bore 52, defined by the inner wall of the housing base. The housing base bore 52 has a diameter larger than the diameter of the housing extension bore 50, for purposes described below. The housing extension bore 50 and the housing base bore 52 are coaxial, with the housing extension bore extending to the housing base bore. The housing base bore has an internal, cylindrical recessed area 56, for a purpose also described below. The internal recessed area 56 has a diameter to create an internal ledge 58 generally perpendicular to the inside wall of the housing base 42.

The reason that the cymbal spinner 10 spins is its inclusion in its housing base 42 of a cylindrical roller bearing 60, such as a roller ball bearing, and more particularly as presently preferred a cylindrical roller ball bearing known to those skilled in the art of roller bearings as a "608 roller bearing," sometimes called a "608 roller ball bearing." Since there are many types of roller bearings which can function well as part of the cymbal spinner in addition to a roller ball bearing, such as cylindrical roller bearings, spherical roller bearings, gear bearings, tapered roller bearings and needle roller bearings, for example, the more generic term "roller bearing" will be used herein, even though the 608 roller bearing is presently preferred due to its ready commercial availability from a number of sources.

Figure 6:
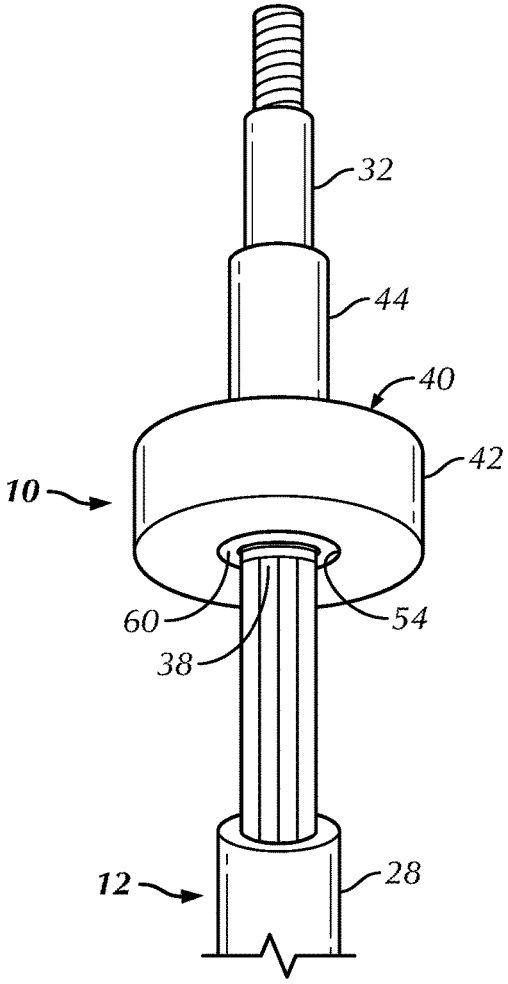
FIG. 6 is a bottom isometric view of the cymbal spinner mounted on a mounting rod of a cymbal stand.
Figure 7:
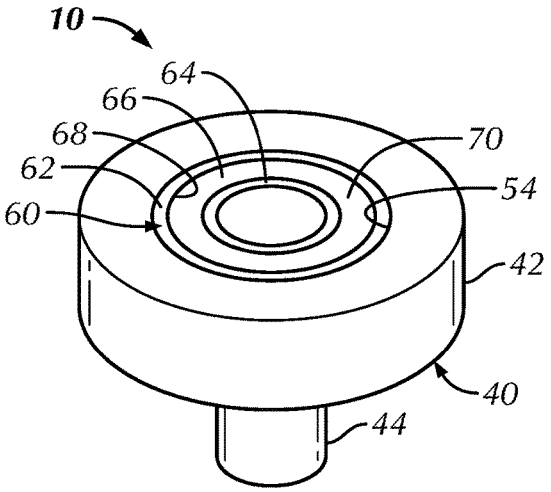
FIG. 7 is a bottom isometric view of the cymbal spinner.

As best shown in FIGS. 6 and 7, the roller bearing 60 is friction fit tightly into the bore 52 of the base 42 of the housing 40. The roller bearing 60, exemplified in the drawings as a roller ball bearing, comprises a bearing outer race 62, where the outside wall of the outer race is held, preferably by friction, but also possibly by any suitable adhesive, tightly against the inner wall 54 of the cymbal spinner housing base 42. The roller ball bearing 60 shown in FIGS. 6 and 7 also comprises an inner race 64 and a roller bearing housing 66 with a top roller bearing housing wall and a bottom roller bearing housing wall 68. Roller balls 70, sometimes called ball bearings, are retained in grooves between the outer race 62, the inner race 64, the roller bearing housing top wall (not shown) and the roller bearing bottom wall 68 such that the inner outer race 62 rotates or spins freely while the inner race 64 remains stationary.

The roller bearing is inserted into the cymbal spinner housing base bore 52 until the top wall (not shown) of the roller bearing or the top wall of the roller bearing outer race 62 abuts against the internal ledge 58 that partially extends into the recessed area 56 in the cymbal spinner housing base bore 52. The recessed area allows any portion of the roller balls 70 that can extend somewhat beyond the top wall of the roller bearing or the top wall of the outer race 62 can move freely without friction with any inner surface of the cymbal spinner base 42.

The roller bearing inner race 64 is supported on the seat 38 at the top of the lower portion 36 of the cymbal mount rod 28, best seen in FIGS. 1 and 6. Because the roller bearing is supported on the seat 38 generally firmly without rotating and the housing 40 of the cymbal spinner readily spins due to the roller bearing 60 tightly held in the bore 52 of the cymbal spinner housing base 42, the entire cymbal spinner housing 40 spins very freely around a longitudinal axis of the cymbal mount rod 28. The longitudinal axis extends through the cymbal spinner housing base 42, the cymbal spinner extension 44, the cymbal mount rod upper smooth portion 34 and the upper threaded portion 32.

In use, with reference to FIG. 1, a cymbal 14 of any diameter desired is placed upon the spinner housing 40, a cymbal mounting bore having a diameter slightly greater than the diameter of the outer wall 48 of the cymbal spinner housing extension 44. The cymbal can be placed directly on the spinner housing and supported on the upper surface of the cymbal spinner housing base or preferably, on a felt washer 16 that is supported on the upper surface of the cymbal spinner housing base. If desired, though not necessary, another felt washer (not shown) can be placed on top of the cymbal 14 and secured loosely by an optional nut (not shown) threaded on the threaded upper portion 32 of the cymbal mount rod 28.

A drummer need only apply the cymbal spinner 10 to his or her cymbal stand 12 and simply spin the cymbal 14 as one would a lazy susan, with the flick of the wrist. Since the cymbal is supported by the cymbal spinner 10, which freely spins due to the roller bearing 60 mounted in the bore 52 of the cymbal spinner housing base 42, the cymbal may spin for many minutes with just a single spin motion initiated by the drummer. Larger diameter cymbals, such as at least about 16 inches (about 40.6 cm) in diameter for example without limitation, will spin longer than smaller diameter cymbals due to their greater mass and rotational momentum. The sound of the spinning cymbal is distinct from the sound of a stationary cymbal when struck by a drummer's drumstick. The sound made is similar to the sound from a vibraphone or rotary speaker.

Another pleasing use of a spinning cymbal is when a chain (not shown) that can be supported by a boom (not shown) clamped or otherwise attached to the cymbal mount rod upper threaded portion 42 is allowed to dangle so that a lower portion of the chain is against the upper surface of the spinning cymbal. This is known as a "sizzler." This produces a type of pleasing background low tinkling type of "white noise" throughout a number during a performance, without hindering the effect when the spinning cymbal is stuck by a drummer's drumstick, described above. Moreover, the use of the cymbal spinner of the present invention, allowing for spinning cymbals, and indeed, with rather sustained spinning times, has led to the decorative effects of kinetic art and other designs on cymbals, such as painted spiral patterns that provide interesting visual enjoyment when they are used on the spinning cymbals.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as illustrated and described in this application.

I claim:

1. A rotatable cymbal mount for mounting a cymbal to a cymbal stand, the rotatable cymbal mount comprising:

a unitary housing having a base portion and an extension portion, the base portion and the extension portion each containing a bore defining an inner wall of the base portion and of the extension portion, the extension portion positioned substantially perpendicularly to the base portion, the base portion having a bottom edge and a substantially flat upper surface arranged substantially parallel to one another, and the flat upper surface having sufficient width to support a cymbal thereon; and a roller ball bearing mounted within the base portion of the housing, the bearing being mountable on a cymbal stand and further allowing the housing to rotate about the bearing.

2. The rotatable cymbal mount of claim 1, wherein the base portion and the extension portion of the housing are substantially cylindrically shaped.

3. The rotatable cymbal mount of claim 2, wherein the base portion and the extension portion each have a diameter, and wherein the diameter of the base portion is at least two times larger than the diameter of the extension portion.

4. The rotatable cymbal mount of claim 1, wherein the housing is constructed of a polymeric material.

5. The rotatable cymbal mount of claim 1, wherein the bore of the base portion and the bore of the extension portion each have a diameter, and wherein the diameter of the bore of the base portion is larger than the diameter of the bore of the extension portion.

6. The rotatable cymbal mount of claim 5, further comprising:

a recessed area within the base portion positioned between the bore of the base portion and the bore of the extension portion.

7. The rotatable cymbal mount of claim 6, wherein the recessed area is configured to receive a portion of the bearing.

8. The rotatable cymbal mount of claim 1, wherein the roller ball bearing comprises an outer race, an inner race, a housing, and a plurality of roller balls positioned within the housing.

* * * * *